US005541826A

United States Patent [19]

Sandell et al.

[11] Patent Number: 5,541,826

[45] Date of Patent: Jul. 30, 1996

[54] QUARTZ LAMP WITH QUICK-RELEASE ARRANGEMENT FOR BULB REPLACEMENT

[75] Inventors: Donald R. Sandell, San Jose; Gary Bordenkircher, Livermore, both of Calif.

[73] Assignee: Larry C. Y. Lee, Hayward, Calif.

[21] Appl. No.: 288,129

[22] Filed: Aug. 10, 1994

[51] Int. Cl.[6] ..... F21S 3/00

[52] U.S. Cl. ..... 362/217; 362/220; 362/221; 362/226

[58] Field of Search ..... 362/217, 220, 362/221, 226, 285, 429, 457, 418; 493/243, 242

[56] References Cited

U.S. PATENT DOCUMENTS

| | | | |
|---|---|---|---|
| 2,694,774 | 11/1954 | Clark | 362/226 |
| 3,141,719 | 7/1964 | Moore | 362/217 |
| 3,390,373 | 6/1968 | Ruston | 362/217 |
| 3,909,100 | 9/1975 | Hodge, Jr. | 362/220 |
| 4,980,809 | 12/1990 | Baldwin et al. | 362/375 |

FOREIGN PATENT DOCUMENTS

| | | | |
|---|---|---|---|
| 220036 | 6/1959 | Australia | 362/223 |
| 562463 | 5/1958 | Belgium | 362/220 |
| 957160 | 5/1964 | United Kingdom | 362/226 |

*Primary Examiner*—Denise L. Gromada
*Assistant Examiner*—Y. Quach
*Attorney, Agent, or Firm*—Elliot B. Aronson

[57] ABSTRACT

A quartz lamp that permits the bulb to be replaced from a side port without disassembling the lamp housing, and without having to touch the quartz envelope of the bulb. The lamp has an access port in a side wall of the lamp housing through which an expired bulb is extracted and a replacement bulb is installed. A knob seats in the access port where it is lockable into its seated position. Attached to the inner surface of the knob is a first bulb holder assembly, which receives and holds the bulb at one of its ends and establishes electrical contact with the bulb at that end. A second bulb holder assembly is secured within the lamp housing at a position opposite the access port and in registration with the first bulb holder assembly. The second bulb holder assembly receives and holds, and establishes electrical contact with, the bulb at the opposite end when it is inserted into the lamp housing through the access port. The second bulb holder assembly mounted within the lamp housing may be electrically connected directly to an electrical power lead. The first bulb holder assembly has a first electrical contact member that is electrically connected to an electrical power lead within the lamp housing and is secured within the lamp housing. A second electrical contact member is mechanically and electrically secured to the first bulb holder assembly and is arranged to electrically engage the first electrical contact member when the knob is in its seated position so as to connect the power lead to a bulb in the first bulb holder assembly when the bulb and assembly are inserted into the lamp housing and the knob is seated in the access port. Removal of the knob with attached first bulb holder assembly thus permits the bulb to be changed without opening up the lamp housing.

13 Claims, 3 Drawing Sheets

QUARTZ LAMP WITH QUICK-RELEASE ARRANGEMENT FOR BULB REPLACEMENT

BACKGROUND OF THE INVENTION

The present invention relates to lamps of the type commonly used for outdoor area lighting and known alternatively as quartz lamps or halogen lamps.

Quartz lamps are often used for area lighting because they can provide considerable light over a comparatively wide area more efficiently than an incandescent lamp. The lamps are called "quartz" lamps because they contain a bulb that typically has a quartz or equivalent fused silica envelope. The envelope contains a halogen gas as an active agent for emitting the light. The envelope is slender, typically about four inches (ten centimeters) long, and has metallic electrical contacts on both ends. In known quartz lamps the bulb is commonly held in place by inserting the ends into bulb holder/contacts, which may include spring-biased mounts or bayonet mounts or other types of mounts for holding the bulb in place and for assuring good electrical contact with electrical leads in the lamp housing. The lamp housing typically contains a reflector positioned behind the bulb and a transparent, typically glass, window positioned in front of the reflector and bulb.

With quartz lamps of the past it is awkward to change the halogen bulb. In known designs it is typically necessary to open up the lamp housing and remove the glass window to gain access to the bulb within the housing. Thus, prior quartz lamp housings have typically been formed of separable halves or formed with a large window that could be removed and that provided sufficient room for the user to reach in and grasp the bulb. An expired bulb may then be removed by reaching into the housing and twisting or otherwise manipulating the bulb until it pops out of its holder/contacts. A new replacement bulb is then inserted by a similar manipulation, and the housing and glass window are re-assembled. Changing the bulb in this manner presents a number of inconveniences and hazards. The working conditions are not always the best because the lamp is often mounted in an inconvenient location. The lamps are typically mounted high on the wall of a building or under a soffit, or they may be mounted high on a post or on a low support, for example, by a pathway. In any event, the lamp is not usually mounted in a convenient position for disassembling and for manipulating the bulb inside. It is not uncommon to need a ladder to gain access to the lamp for replacing the bulb. In addition to the grace and dexterity required to change the bulb under these circumstances, there is a potential hazard from the edges of the glass window, which are typically sharp enough to cut the user if not handled carefully during the disassembly and replacement. And there is always the possibility of dropping the glass window and breaking it while replacing the bulb. There is the further hazard of electrical shock if the power has not been turned off, because the interior of the lamp housing and the live electrical contacts may be exposed. Furthermore, it is desirable to handle the envelope of a new halogen bulb as little as possible because residues left on the envelope from finger oils can lead to premature failure of the bulb. However, in the conventional method of changing a halogen bulb, some handling of the envelope of the bulb has been unavoidable when the two ends are inserted into their respective bulb holders/contacts.

SUMMARY OF THE INVENTION

The present invention provides a quartz lamp that permits the bulb to be replaced without removing the transparent window, without partially disassembling the housing, and without having to touch the quartz envelope of the bulb at all.

Briefly, a lamp according to the invention has an access port in a side wall of the lamp housing through which an expired bulb is extracted and a replacement bulb is installed. A knob seats in the access port and may be simply locked into its seated position, for example, merely by turning the knob a quarter turn. Attached to the inner surface of the knob is a first bulb holder assembly, which receives and holds the bulb at one of its ends and establishes electrical contact with the bulb at that end. A second bulb holder assembly is secured within the lamp housing at a position opposite the access port and in registration with the first bulb holder assembly. The second bulb holder assembly receives and holds, and establishes electrical contact with, the bulb at the opposite end when it is inserted into the lamp housing through the access port. The second bulb holder assembly mounted within the lamp housing may be electrically connected directly to an electrical power lead, and for safety reasons is preferably connected directly to the hot power lead. The first bulb holder assembly cannot be connected directly to a power lead because the bulb holder assembly must be removable from the lamp housing when the knob is unlocked from the access port for changing the bulb. To circumvent this problem, the first bulb holder assembly has a first electrical contact member that is electrically connected to an electrical power lead within the lamp housing and is itself secured within the lamp housing. A second electrical contact member is mechanically and electrically secured to the first bulb holder assembly and is arranged to electrically engage the first electrical contact member when the knob is in its seated position.

The invention provides great ease and convenience in replacing the halogen bulb. It is an advantage of the invention that the user is never given access to the sharp edges of the glass window. This greatly reduces, if not eliminates, the danger of injury to the user from the glass or damage to the glass when replacing the bulb. It is also an advantage that the user is not provided access to the interior regions of the lamp housing, which greatly reduces the danger of electrical shock from inadvertently touching a live contact or damaging an inactivated contact while changing the bulb.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
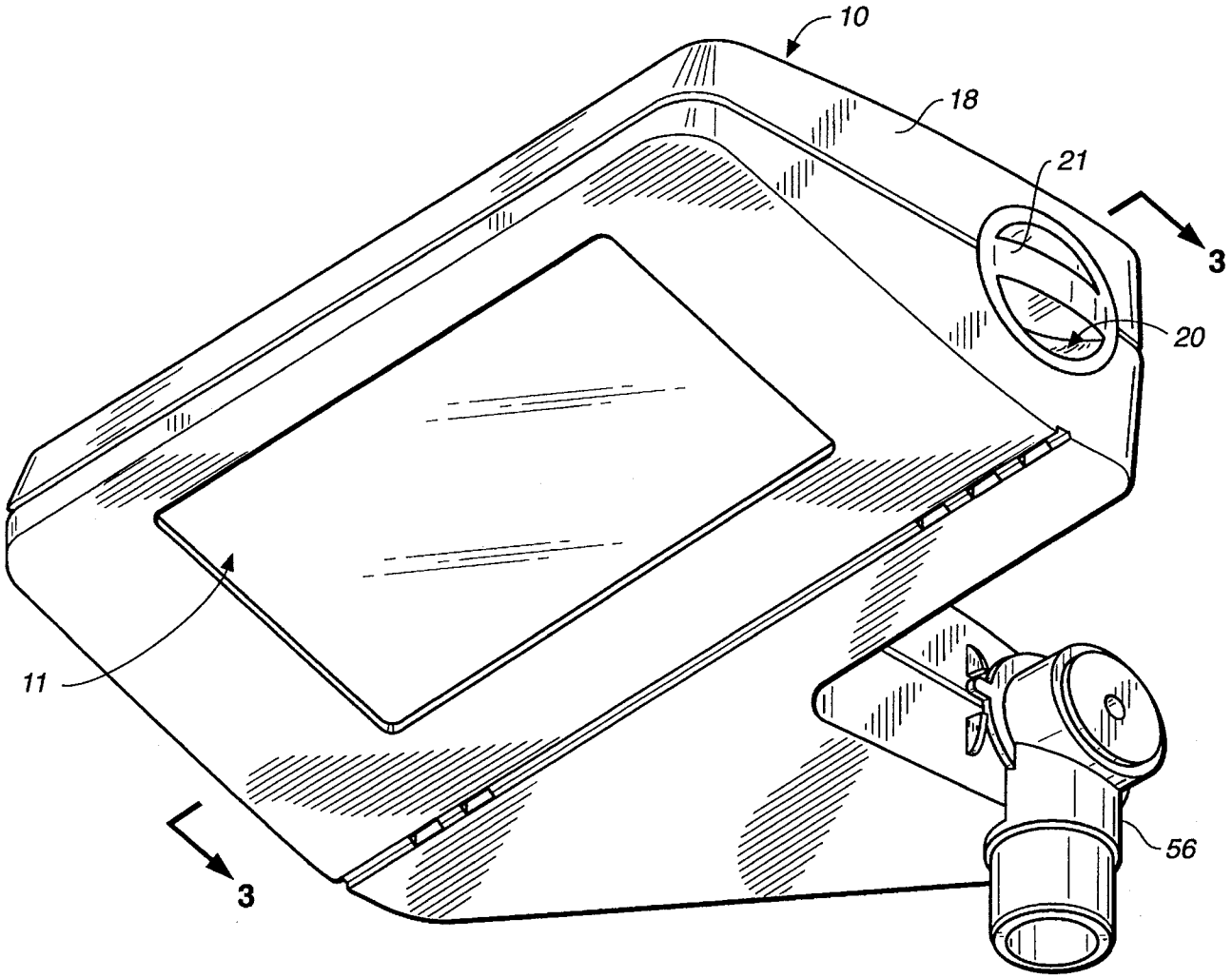
FIG. 1 is a perspective view of a quartz lamp according to the invention.
Figure 2:
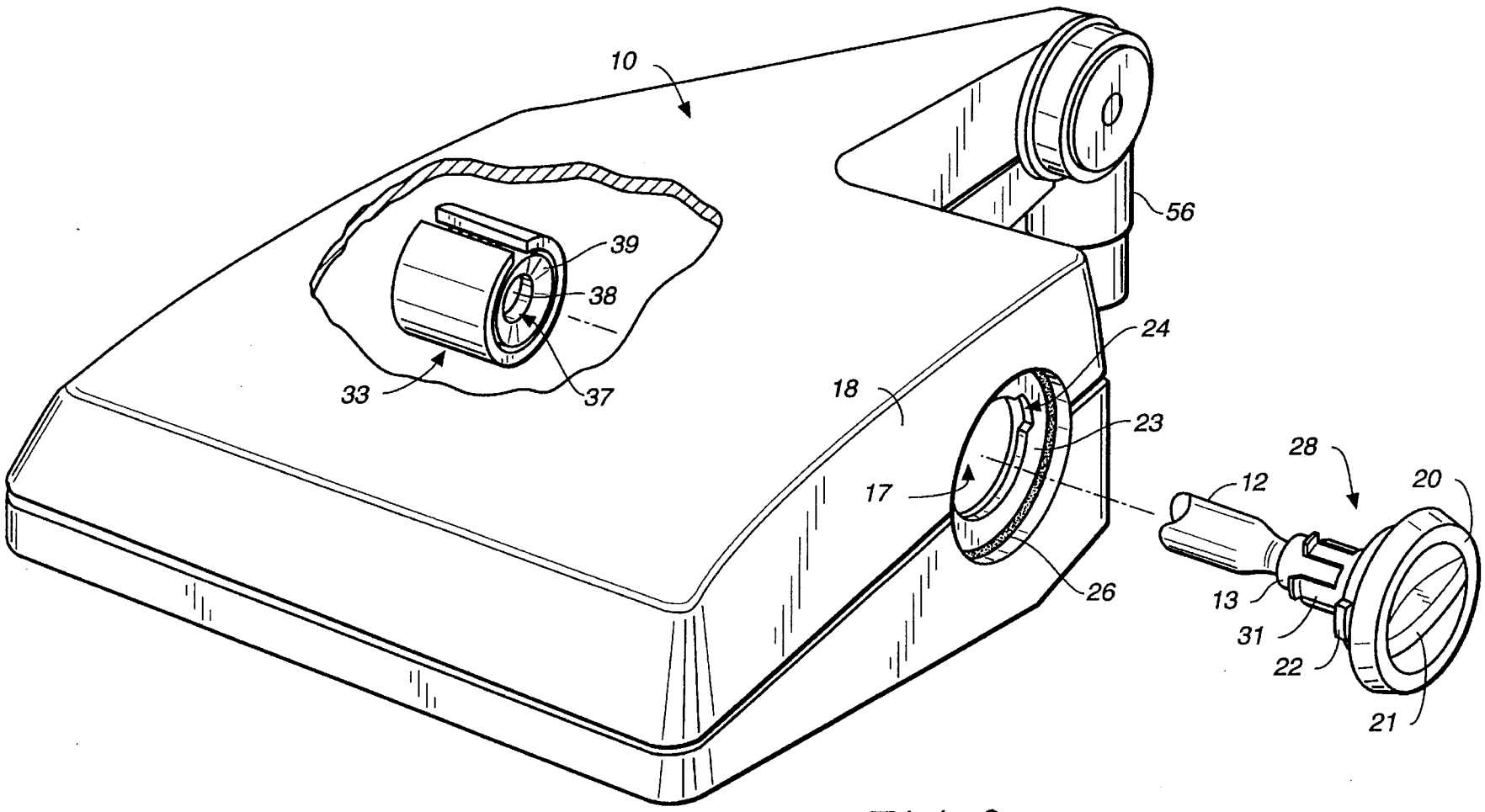
FIG. 2 is a partially cut-away, partially exploded perspective view of the quartz lamp of FIG. 1 showing a quick-release mounting mechanism for a replaceable bulb.

FIGS. 1 and 2 show overall views of one embodiment of a quartz lamp according to the invention. A lamp housing 10 includes a transparent window 11, which may be a glass window or other form of transparent material commonly used in quartz lamps. Within the lamp housing (see FIG. 3) illumination is provided by a double-ended bulb 12, which is preferably a conventional halogen-cycle quartz bulb. The bulb has an overall elongate shape defined by a transparent quartz tube or envelope and terminates at opposite ends in electrical contacts 13 and 14 for electrically energizing the bulb. The contacts may, for example, take the form of short metal caps at the ends of the quartz envelope. A conventional 150-Watt bulb is commonly four inches long, although the present invention may of course be used with bulbs of other sizes. Included within lamp housing 10 is a reflector 16 positioned behind bulb 12 and window 11 and extending the length of bulb 12. The reflector is of conventional design and may be metallic, ceramic or of other material. The details of the reflector are not part of the present invention, which may be used with reflectors of different designs.

Lamp housing 10 and window 11 are sealed for protection against the elements in the environment of intended use. To gain access to bulb 12, an access port 17 is defined in side wall 18 of the lamp housing. Access port 17 is closed off by a knob 20, which seats in the access port. Knob 20 is formed with a grip 21 that may readily be grasped by the user to provide leverage for turning the knob. Knob 20 may be locked in its seated position on the access port. In the embodiment illustrated here this is achieved by a pair of diametrically opposed tabs 22 on knob 20 and a locking ring 23 with recessed regions 24 mating with tabs 22. Locking ring 23 has a central aperture through which the bulb passes as it is inserted into the lamp housing. Thus, knob 20 may be locked in its seated position on the access port by inserting the knob with the tabs passing through recesses 24 and rotating the knob a quarter turn. In this way, the knob is easily removed by rotating it until tabs 22 line up with recesses 24. The skilled practitioner will appreciate that other configurations of tabs, recesses, interengaging members, or other forms of connections may alternatively be used for locking knob 20 in seated position. To assure a good seal against moisture, dust, or other environmental elements, an o-ring 26 is provided in locking ring 23 to engage an inner surface of knob 20 when the knob is in its seated position. The o-ring provides a tight water seal for protecting the electrical connections against harm from moisture. Although other forms of gaskets or sealing arrangements could be used in place of o-ring 26, the o-ring is preferred because it is less subject to wear from engaging surfaces where movement is encountered, and because it additionally provides a spring action helping to lock knob 20 in place.

Figure 3:
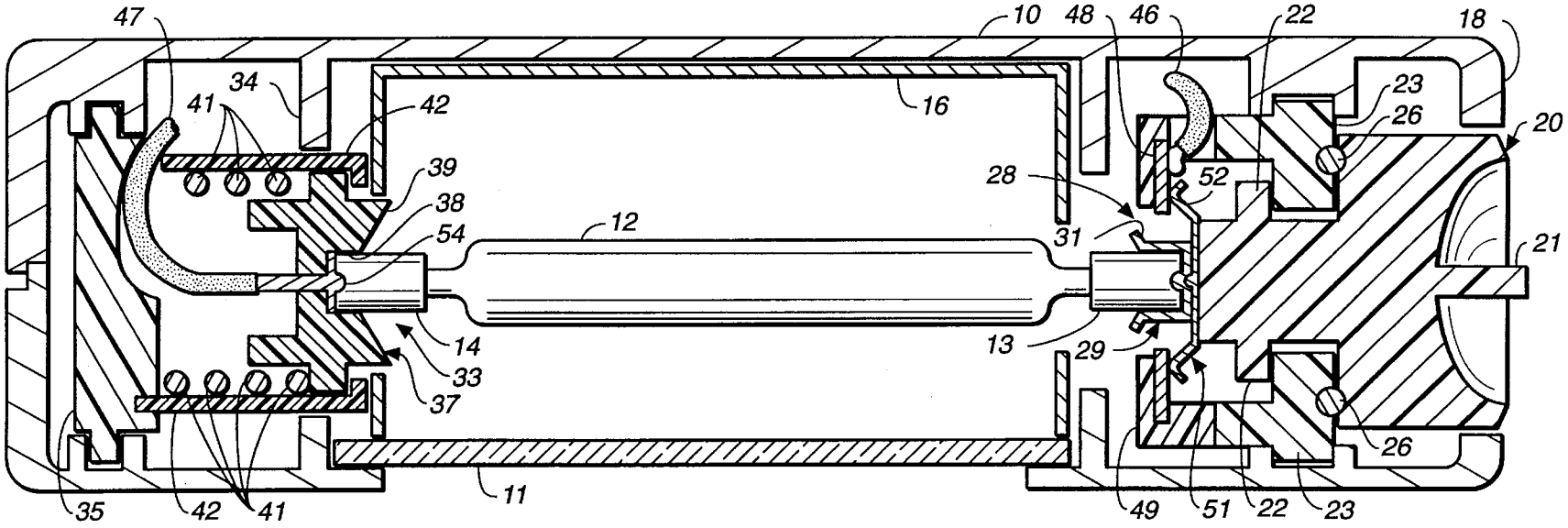
FIG. 3 is a cross-sectional view of the quartz lamp of FIG. 1 taken along the line 3—3.

Two bulb holder assemblies are provided for supporting bulb 12 and providing electrical connection with the contacts 13 and 14 at the opposite ends of the bulb. A first bulb holder assembly, indicated generally at 28, is secured to the inner face of knob 20. The assembly includes a receiving member 29 that is shaped to snugly receive an end of bulb 12. In the embodiment of FIGS. 2 and 3 receiving member 29 is provided by a metal cup formed with spring-biased metal fingers 31 that frictionally engage the sidewall of bulb contact 13 and hold the bulb securely in place.

The second bulb holder assembly, indicated generally at 33, is secured in fixed position within lamp housing 10 at a position opposite access port 17. As shown in FIG. 3 bulb holder assembly 33 is secured to intermediate insulating wall 34 and insulating backstop 35, although other means of securement may also be used. Bulb holder assembly 33 also includes a receiving member 37 for receiving and snugly holding the contact end 14 of bulb 12. Unlike receiving member 29 of the first bulb holder assembly 28, receiving member 37 is formed of an insulating material and has an inner cup-shaped portion 38 formed to conform generally to the shape of the contact end 14 of bulb 12 and has an outer portion 39 formed with generally concave, sloping walls for guiding contact end 14 into the inner portion 38 where it will be securely held.

To help hold bulb 12 securely and maintain good electrical contact, receiving member 37 is spring-biased toward the first bulb holder assembly. For this purpose coil spring 41 is positioned behind receiving member 37, and both spring 41 and receiving member 37 are constrained to move longitudinally within cylinder 42.

To energize the bulb, lamp housing 10 includes two electrical leads 46 and 47, which are connected to a source of power in conventional manner. Electrical lead 46 is connected to an electrical contact member 48, which in the embodiment of FIG. 3 is provided by an annular band having an inner diameter sufficient to permit bulb 12 and fingers 31 to pass through. Contact member 48 is supported on insulating band 49, which is secured to locking ring 23 and thus to lamp housing 10. A second electrical contact member, which is provided in the embodiment of FIG. 3 by a metal spring clip 51, is secured to bulb holder 28. Spring clip 51 is secured between receiving member 29 and the inner surface of knob 20 and a lateral region 52 of spring clip 51 protrudes beyond the lateral extent of receiving member 29. When knob 20 is in its seated position, lateral region 52 of spring clip 51 engages annular contact member 48. Thus, an electrical connection is established from lead 46 to annular contact member 48 to spring clip 51, to metal receiving member 29 to bulb contact 13.

The electrical connection to bulb holder assembly 33 is established somewhat differently. Lead 47 passes through the center of insulating receiving member 37 and is connected to a contact lug 54 in inner cup-shaped portion 38. As shown in FIG. 3 contact lug 54 has the form of a small circular plate lining the bottom of cup-shaped portion 38. For safety considerations lead 47 is preferably the hot, or black, lead and lead 46 is the neutral, or white, lead.

In operation, a spent bulb is removed by twisting the knob, pulling the knob and bulb holder assembly out of the lamp housing, and then pulling the spent bulb from the grasp of the first bulb holder assembly. The user then grasps a new bulb at electrical contact 14 at one end (being careful not to grasp the envelope portion of the bulb) and inserts the other end of the bulb into the first bulb holder assembly. The unit is then inserted into the access port. Aligning knob 20 with the access port automatically aligns the opposite end of the bulb approximately with the insulating receiving member 37 of the second bulb holder assembly. Contact end 14 is guided into inner receiving portion 38 by the sloping walls of outer receiving portion 39. Twisting the knob then locks the new bulb into place.

The above descriptions and drawings disclose illustrative embodiments of the invention. Given the benefit of this disclosure, those skilled in the art will appreciate that various modifications, alternate constructions, and equivalents may also be employed to achieve the advantages of the invention. For example, the bulb holder assemblies can be configured in a number of ways. For proper operation of the invention it is important that the bulb holder assemblies each firmly hold the bulb mechanically at one end and establish good electrical connection with the terminal contact on the bulb, yet the user must be able to extract the bulb easily from the assembly. The embodiments shown in the figures achieve these objects in a particularly convenient manner because they require only a small number of low-cost parts for the total assembly. Other arrangements may be devised to accomplish these objects, but for the purposes of the invention all such arrangements meeting these objects are considered to be equivalent to those illustrated here. Furthermore, in the particular embodiment illustrated above the lamp housing is shaped with a downward facing window and is supported on post 56. Those skilled in the art may readily adapt the quick-release bulb replacement arrangement of the present invention to lamp housings of other shapes and other support mechanisms. Therefore, the invention is not to be limited to the above description and illustrations, but is defined by the following claims.

What is claimed is:

1. A lamp for use with a replaceable halogen bulb, said bulb having an elongate shape and having electrical contacts at opposite ends thereof, and said lamp including first and second electrical leads for energizing said bulb, said lamp comprising:

a lamp housing having an access port in a side wall thereof;

a knob for seating on said access port;

locking means for locking said knob in seated position on said access port and for releasing said knob therefrom;

a first bulb holder assembly for receiving and holding said bulb at a first of said opposite ends and establishing electrical contact therewith, said first bulb holder assembly being secured to said knob;

a second bulb holder assembly for receiving and holding said bulb at a second of said opposite ends and establishing electrical contact therewith, said second bulb holder assembly being secured within said lamp housing at a position opposite said access port in registration with said first bulb holder assembly when said knob is in said seated position and spaced apart therefrom so as to receive and hold said bulb at said second end;

said second bulb holder assembly being electrically connected to said second electrical lead for establishing electrical connection between said second electrical lead and said second end;

a first electrical contact member electrically connected to said first electrical lead and secured within said lamp housing; and a second electrical contact member secured to said first bulb holder assembly and electrically connected therewith, wherein said first and second electrical contact members are shaped and disposed to electrically engage one another when said knob is in said seated position for establishing electrical connection between said first electrical lead and said first end;

whereby said bulb held in said first bulb holder assembly on said knob will be received and held in said second bulb holder assembly, and electrically connected to said first and second leads at said first and second opposite ends when said knob is in said seated position on said access port.

2. The apparatus of claim 1 wherein said first bulb holder assembly includes a receiving member having an electrically conducting portion shaped for mechanically holding said bulb at an end and establishing electrical contact therewith.

3. The apparatus of claim 2 wherein said electrically conducting portion comprises an electrically conducting cup-shaped base for receiving said end of said bulb and a plurality of electrically conducting, spring-biased fingers extending from said base for grasping said electrical contact at said end of said bulb.

4. The apparatus of claim 2 wherein said second electrical contact member secured to said first bulb holder assembly comprises an electrically conducting member having a portion extending laterally with respect to a bulb held in said first bulb holder assembly and disposed for engaging said first electrical contact member electrically connected to said first electrical lead.

5. The apparatus of claim 4 wherein said portion extending laterally is spring-biased.

6. The apparatus of claim 4 wherein said first electrical contact member electrically connected to said first electrical lead comprises a laterally extending electrically conducting engagement surface for engaging said laterally extending portion of said first electrically conducting member.

7. The apparatus of claim 6 wherein said engagement surface is provided by a substantially annular band with central aperture having a diameter sufficient to receive said bulb, said band being disposed with said central aperture in registration with said first bulb holder assembly in its seated position.

8. The apparatus of claim 7 wherein said first electrical contact member electrically connected to said first electrical lead further comprises an insulating support member, said substantially annular band being mounted on said insulating support member.

9. The apparatus of claim 1 wherein said locking means comprises a locking ring secured within said lamp housing having a central aperture for receiving said first bulb holder assembly, said locking ring and said knob being formed with a plurality of interlocking tabs and tab-receiving recesses.

10. The apparatus of claim 9 further comprising an o-ring seal seated on said locking ring for engaging and sealing said knob in its seated position.

11. The apparatus of claim 1 wherein said second bulb holder assembly includes an insulating receiving member having an inner cup-shaped portion formed to conform generally to the shape of an end of said bulb and having an outer portion formed with generally concave, sloping walls for guiding said end of said bulb into said inner cup-shaped portion.

12. The apparatus of claim 11 further comprising an electrical contact lug seated in said inner cup-shaped portion and electrically connected to said second electrical lead.

13. The apparatus of claim 11 further comprising means for biasing said insulating receiving member toward said access port.

* * * * *